United States Patent [19]

Vogel

[11] 4,145,893

[45] Mar. 27, 1979

[54] DIVERSION DEFROST DISPLAY CABINET

[75] Inventor: Robert E. Vogel, Marshall, Mich.

[73] Assignee: Kysor Industrial Corporation, Cadillac, Mich.

[21] Appl. No.: 837,370

[22] Filed: Sep. 28, 1977

Related U.S. Application Data

[63] Continuation-in-part of Ser. No. 810,973, Jun. 29, 1977, Pat. No. 4,117,698.

[51] Int. Cl.[2] ..... F25D 21/06; A47F 3/04

[52] U.S. Cl. ..... 62/151; 62/248; 62/255; 62/256

[58] Field of Search ..... 61/151, 248, 255, 256

[56] References Cited

U.S. PATENT DOCUMENTS

| | | | |
|---|---|---|---|
| 2,257,948 | 10/1941 | Green | 62/255 |
| 2,483,804 | 10/1949 | Brinkoeter | 62/255 |
| 3,063,253 | 11/1962 | Dickson et al. | 62/256 |
| 3,063,254 | 11/1962 | Dickson et al. | 62/256 |
| 3,182,467 | 5/1965 | Beckwith | 62/256 |
| 3,263,063 | 7/1966 | Marriott et al. | 62/248 |
| 3,465,536 | 9/1969 | Vogel et al. | 62/256 |
| 3,911,245 | 10/1975 | O'Shaughnessy | 62/248 |
| 3,937,033 | 2/1976 | Beckwith et al. | 62/256 |
| 4,026,121 | 5/1977 | Aokage et al. | 62/151 |

*Primary Examiner*—Lloyd L. King

*Attorney, Agent, or Firm*—Price, Heneveld, Huizenga & Cooper

[57] ABSTRACT

An energy conserving refrigerated display case having a control circuit that diverts electrical energy from the antisweat heaters operable during the refrigeration mode of the display, to an evaporator defrost heater during the defrost mode of the display.

6 Claims, 4 Drawing Figures

DIVERSION DEFROST DISPLAY CABINET

RELATED APPLICATIONS

This is a continuation-in-part application of copending application Ser. No. 810,973 filed June 29, 1977 and entitled REFRIGERATED DISPLAY, now U.S. Pat. No. 4,117,698.

BACKGROUND OF THE INVENTION

Refrigerated display cases are widely employed for effectively merchandising food products while maintaining such in prime condition. Yet, because of the significant energy usage requirements of such cases, particulary open front display cases, there is a tendency to cut back on usage thereof in recent times. Energy is required for refrigeration of these cases, for antisweat heat during refrigeration, and often for defrosting. Creative concepts have been put forth recently for decreasing energy consumption of refrigerated display cases. In U.S. Pat. No. 4,026,121, a special reverse flow air defrost system is taught. In patent application Ser. No. 810,973, a unique cover arrangement is taught in combination with reverse flow air defrost. Both developments result in significantly less energy usage. Also basically disclosed in said application Ser. No. 810,973 is an optional feature of diversionary use of electrical power normally employed for antisweat heat through a special control for defrost heat during the defrost mode of the display.

SUMMARY OF THE INVENTION

This invention relates to use of diverted antisweat heat electrical energy in a refrigerated display case during the defrost mode, and more particularly to diversion of such electrical energy to evaporator defrost heaters. Electrical controls that switch the refrigerated display from refrigeration mode to defrost mode divert the electrical energy normally used for antisweat heaters during the refrigeration mode, to evaporator defrost heaters during the defrost mode.

This development achieves significant energy conservation. There are two combinations capable of exhibiting the energy conserving benefits, one being an open front refrigerated display case combining reverse flow air defrost with diversion electrical energy coil defrost, and the other being a door-type display case with diversion electrical energy coil compartment defrost.

The diversion of energy to defrost heat in an open front display case employing reverse flow air defrost causes accelerated defrost, thereby shortening the defrost time period and enabling retention of low food product temperatures. Defrost not only occurs more rapidly, but with less wattage.

In the door-type, i.e. so-called reach-in refrigerated display case or cabinet employing diversion electrical energy defrost, the heat is basically concentrated and confined to a coil chamber, to allow maintenance of low product temperature as well as less energy consumption.

DESCRIPTION OF THE PREFERRED EMBODIMENTS

OPEN FRONT EMBODIMENT

Figure 1:
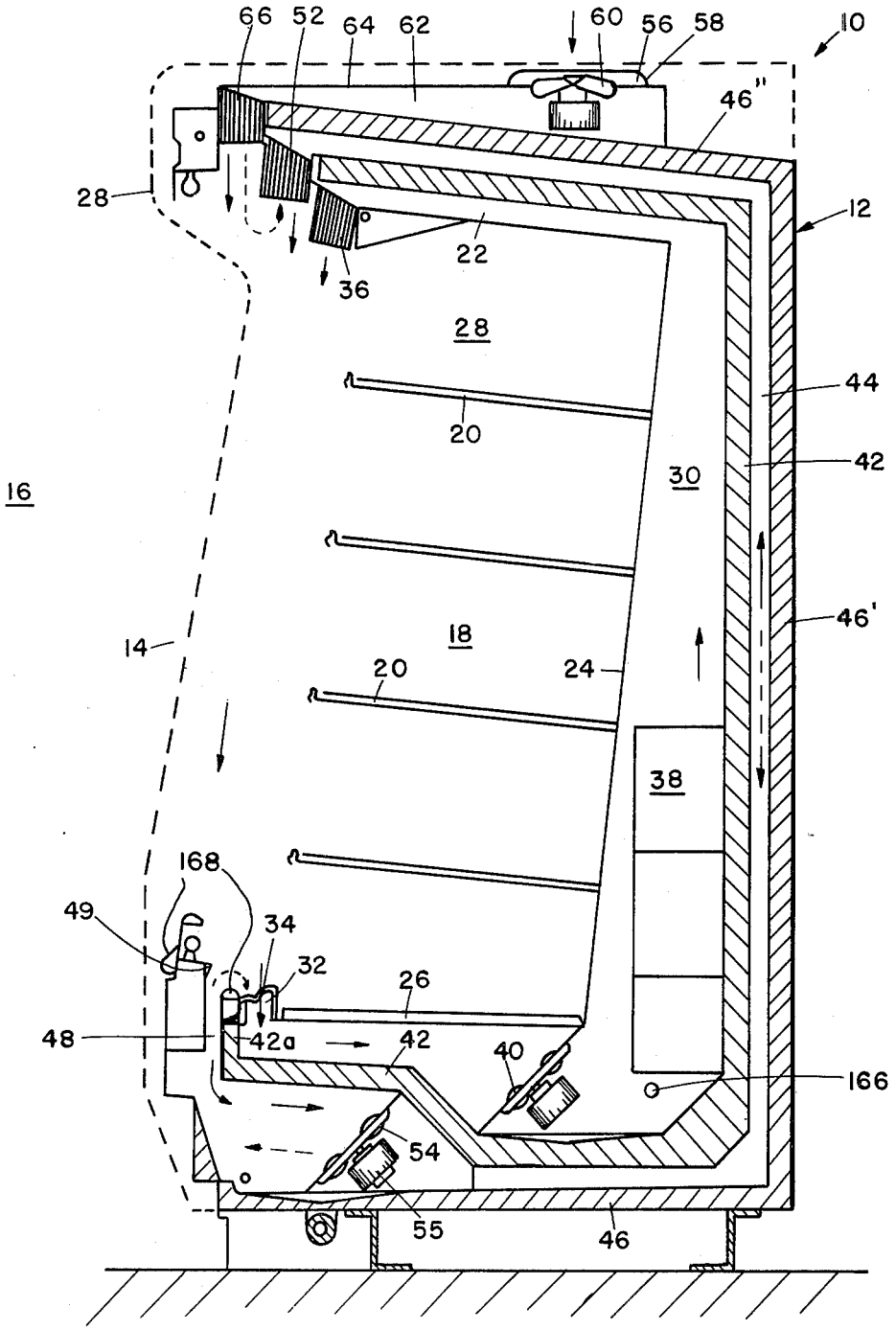
FIG. 1 is a side elevational sectional view of an open front refrigerated display case embodiment of this invention.

Referring specifically to FIG. 1, the open front multiple curtain refrigerated display case 10 constitutes a housing assembly 12 having an access opening 14 over the front thereof, from the ambient air space 16 about the cabinet to the food storage and display space or zone 18 in the cabinet. This structure is normally placed in a grocery store or supermarket, with display space 18 being divided into sections by a plurality of vertically spaced generally horizontal shelves 20. Display space 18 is confined by an upper panel or ceiling 22, a rear panel or wall 24 to which the shelves are attached, a bottom panel 26 which also serves as a support shelf, and a pair of end walls 28.

Extending around and adjacent the bottom 26, back 24 and top 22 of display area or space 18 is an inner, refrigerated air flow passage or conduit 30 extending substantially along the length of the case. Passage 30 has an elongated upwardly oriented air flow inlet 32 extending along the lower edge of access opening 14, and normally covered by a perforate grill 34 which may be electrically heated to prevent frost formation. Along the upper edge of the access opening 14, opposite inlet 32, is an elongated air flow outlet nozzle 36 normally containing downwardly oriented air directing means such as honeycomb as depicted. This outlet nozzle is the innermost of a plurality of outlets, preferably three in number. It discharges refrigerated air down across the open front of the display space to the inlet 32 for recirculation about the case.

Located in passage 30, preferably along the lower rear portion thereof, as in the space behind the downwardly forwardly sloping back panel 24, is evaporator coil means 38 containing the usual tubes and fins, and extending generally along the length of the back panel such that air flow recirculating through the innermost passage of the display must flow through the coil during normal operation. This evaporator refrigeration equipment is operably connected to conventional condensing equipment external of the display case in usual fashion, e.g. on the roof of the store, at the rear of the store, or otherwise, as is normally done.

Also within passage 30, preferably at the bottom portion of the display case, is a plurality of motor operated fans 40 spaced lengthwise along the display case and acting as air propelling means to constantly circulate air drawn into inlet 32, past these fans 40, through passage 30, including coils 38, out outlet 36, and down across the open front 14 of the display case, i.e. in counterclockwise fashion in the form depicted in FIG. 1 as represented by the solid arrows. Thus, the refrigerated air is recirculated in this fashion. Passage 30 is basically defined between the noted panels 26, 24 and 22 forming one side thereof, and a spaced panel or partition 42 extending around the bottom, back and top of the case to form the other side of the passage. The refrigerated air flowing through passage 30 not only forms an enclosing air curtain in the open front of the case, but also a protective envelope around the case.

Partition 42 not only forms the outer wall of inner passage 30, but also forms the inner wall of a second adjacent passage 44 which extends around the bottom, back and top of the case outwardly of passage 30, relative to display space 18. The outer wall of passage 44 is formed by bottom panel 46 and back and top panels 46′ and 46″. Passage 44 includes an elongated inlet 48 adjacent to and outwardly of inlet 32, i.e. along the lower edge of the display opening 14. Opposite this upwardly opening inlet 48 and adjacent the outlet nozzle 36 at the top edge of the display opening 14 is another downwardly oriented elongated outlet nozzle 52 from passageway 44 including air directing means such as honeycomb as depicted. During normal operation, air is circulated through passage 44 by a plurality of motor operated fans 54 preferably in the bottom of the case. These fans propel air from inlet 48 through passage 44, enveloping the refrigerated air passage 30, and out nozzle 52, to form a protective guard curtain of air contiguous with and flowing in the same direction with the refrigerated inner air curtain across the open front of the case. This guard curtain returns to outlet 48 for continuous recirculation, all as shown by the solid arrows in FIG. 1. Typically during normal operation, the temperature of this recirculated guard air through passage 44 is at a temperature somewhat higher than the temperature of the inner refrigerated air curtain, but below ambient temperature. It is cooled somewhat by its association with the inner air curtain. Fans 54 are spaced longitudinally along the passage to obtain relatively uniform flow over the length of this passage.

A third curtain of air at ambient temperature is preferably also employed. This curtain is not recirculated about the case, but rather enters the case at the top and exits in front of the rub rail into the aisle. The ambient air for this third curtain enters the case through a plurality of top inlets 56 covered by perforate grids 58 or the like, the air being drawn down in by a plurality of motor operated fans 60 spaced longitudinally along the top of the case length. The air is then propelled downwardly through elongated passage 62 between panels 46″ and top panel 64 to a third elongated outlet nozzle 66 along the top edge of the case, and directed downwardly across the open front of the case outwardly of the inner two nozzles relative to the display space 18.

Nozzle 66 is adjacent nozzle 52 and preferably at a small acute angle relative thereto, with nozzle 52 also preferably being at a relatively small acute angle relative to nozzle 36, all in known fashion. The air flow normally flowing through nozzle 66 is, as indicated by the solid arrows, flowing across the open front or access opening contiguous with the curtain from nozzle 52, and, at the lower edge of the access opening, separating from the intermediate air guard curtain and flowing out over the rub rail into the aisle area of the store for customer comfort as well as adding inertia to the total air curtain flow.

The motors 55 that operate the guard curtain fans 54 are electrically reversible, as are the fans therefor, to enable air to be forced in the opposite direction for passage 44 from that shown in the solid arrows, i.e. in the direction indicated by the dashed arrows during defrost operation. This reverse flow defrost concept is basically set forth in U.S. Pat. No. 4,026,121. Thus, during defrost, the air is drawn into the intermediate guard nozzle 52, both from the outlet nozzle 66 and also from the ambient atmosphere in front of the case, is circulated around the display, and is discharged up through the opening 48. During defrost, air leaving opening 48 can be drawn down into opening 32, assisted by deflector 49 at the end of opening 48. The panel or wall 42 that separates the conduits 30 and 44 along the bottom of the display case has an upwardly protruding terminal portion 42*a* between the opening 32 and 48.

Figure 2:
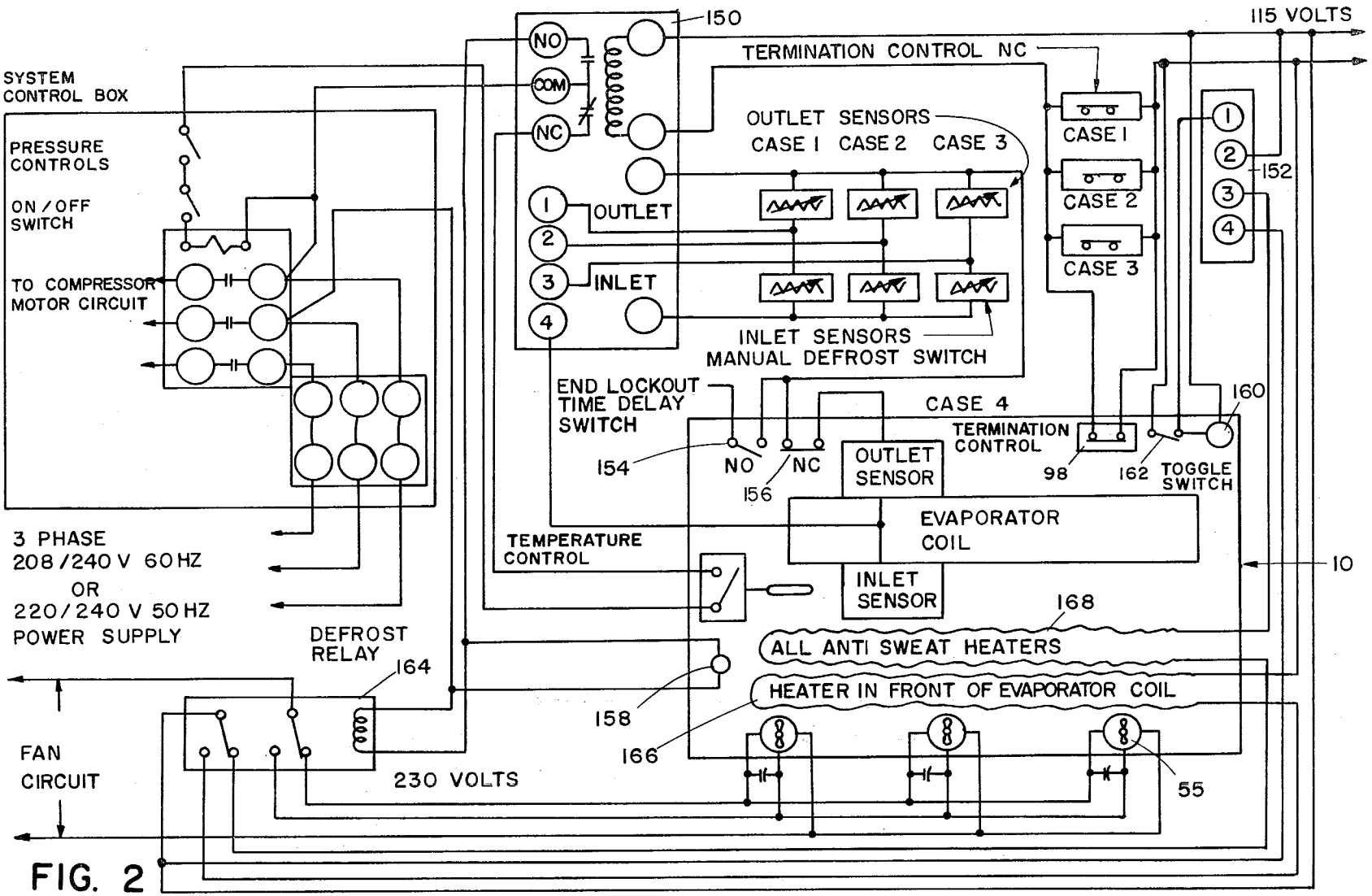
FIG. 2 is a schematic electrical diagram for the embodiment in FIG. 1.

The electrical circuit for the open front embodiment is shown in FIG. 2 in relation to four display cabinets or cases. In this illustrative showing, the fourth case is display cabinet 10 of the other drawings. The defrost controls shown include a demand defrost control 150. That is, defrost occurs when the sensor at the cabinet indicates it needs defrost, as detected by a predetermined difference in temperature between the inlet air to the coil and the outlet air from the coil. The control is marketed by Minneapolis Honeywell Co. as "Honeywell Demand Defrost Control CR70A". Details are set forth in U.S. Pat. No. 3,453,837. A sensor for the control may be placed in each of the multiple of cabinets to cause any one of such to trigger the defrost operation. In such an arrangement, switches 154 and 156, and light 158 would be only on the cabinet on which control 150 is mounted, while each cabinet would have a control 152, switch 162 and light 160. Control 152 is marketed by Minneapolis Honeywell Co. as "Dew Point Controller 4-409A". This demand control may be substituted by a conventional timer-operated defrost control if desired.

Control 152 conserves energy by shutting down the antisweat heaters 168 on the cabinet during defrost, and diverting the power for such to defrost heaters 166 upstream of the coil. Control 152 may be, for example, a "Honeywell Anti-Sweat Control H-409A". Also incorporated into the illustrated circuit are end lock-out time delay manual switch 154, manual defrost activation switch 156, indicator light 158 preferably red, indicator light 160 preferably yellow, toggle switch 162, and double pole, double throw defrost relay 164. The antisweat heaters are connected to the antisweat control 152. This control allows only the required amount of energy to be used by the antisweat heaters to prevent condensation during the refrigeration mode. Percent of energy used will vary from 100% at 65% relative humidity to 0% at 20% relative humidity.

When the cabinet requires a defrost, control 150 will put the cabinet into defrost automatically. The red indicator light will come on, telling the store personnel the slightly warmer temperature in the cabinet is due to the defrost mode and not a malfunction of the refrigeration system. When the cabinet goes into defrost, defrost relay 164 de-energizes all the antisweat heaters 168 and energizes defrost heaters 166 in front of the evaporator coil to work in combination with the warm air propelled through the passages and coil by reversal of the guard curtain. This diversion of heat shortens the defrost period, protecting the product from deteriorating. If it is desired to put the cabinet into a manually activated defrost, the two push button switches 154 and 156 are depressed momentarily.

The combination of reverse flow defrost air and heat from diversion energy is highly effective, yet conserving of energy. In this open front type of case, there would not be sufficient energy from the diverted antisweat requirements alone for defrost. Yet, with the warm ambient air being complemented in this fashion, the results are highly effective.

DOOR-TYPE EMBODIMENT

Figure 3:
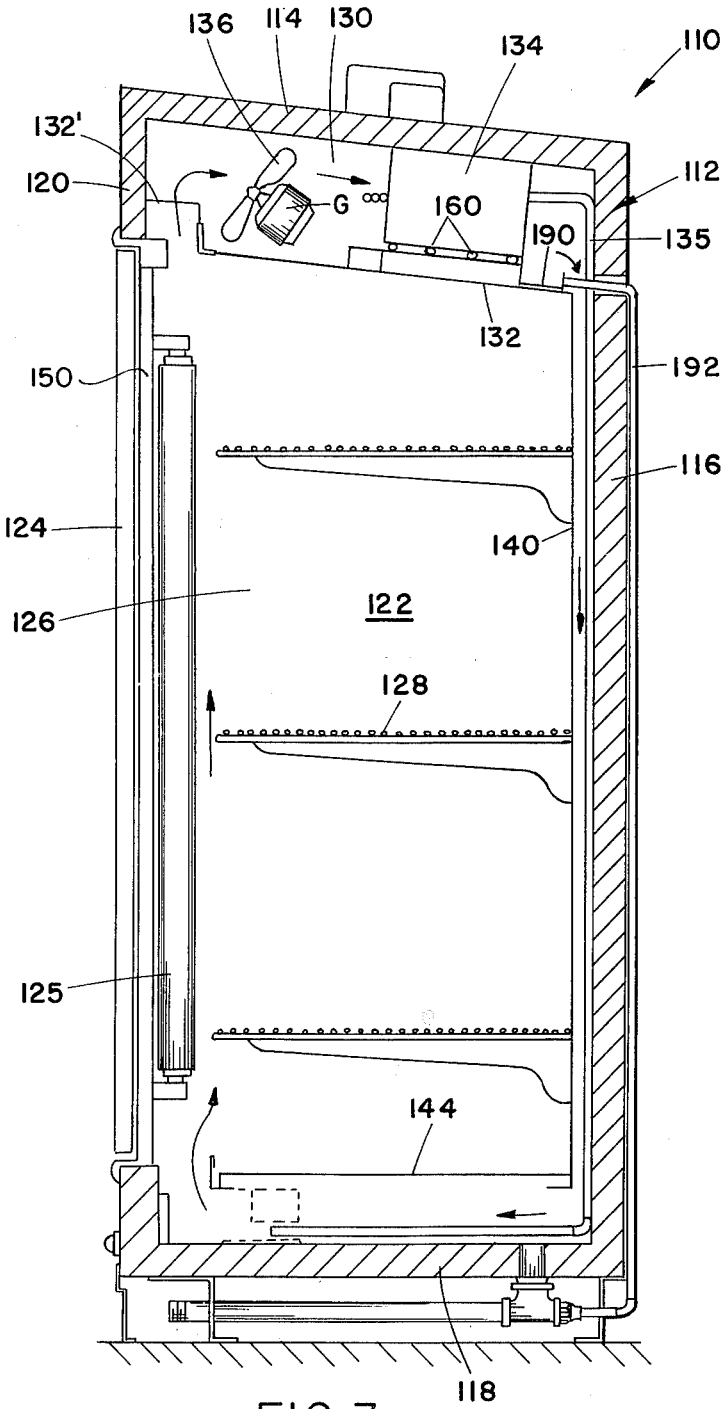
FIG. 3 is a side elevational sectional view of a door-type refrigerated display case embodiment of this invention.

In FIG. 3 is depicted a reach-in or door-type refrigerated display case 110 employing a conventional housing 112 which has a top 114, back 116, bottom 118, front 120 and ends 122. The front includes a plurality of doors 124, usually largely glass to allow viewing therethrough, such doors being slidably or hingedly mounted in conventional fashion for access to the interior product storage and display space 126. The food products are supported on a plurality of vertically spaced, generally horizontal shelves 128 mounted in cantilever fashion from the back of the cabinet.

At the top of the cabinet is a space 130 separated from the product storage and display space 126 by a ceiling panel 132. Within space 130 is mounted a refrigeration coil 134 positioned across the passage so that air propelled by a plurality of motor operated fans 136 is forced through the coil for cooling of recirculated air prior to its passage about the cabinet. The air flows down the back of the cabinet between a back panel 140 and the case back 116, behind the products, through the space below bottom panel 144 and above case bottom 118, and then up in front of the shelved products, i.e. between the products and front doors 124, such air returning through openings 132' in panel 132, back to the fans 136, in recirculatory fashion. Adjacent glass doors 124 are positioned conventional vertically oriented fluorescent lamps 125 for illumination of the display space. Refrigeration coil 134 is in cooperative relationship with a compressor and condensor unit (not shown) located elsewhere through suitable conduits 135 in normal fashion.

Figure 4:
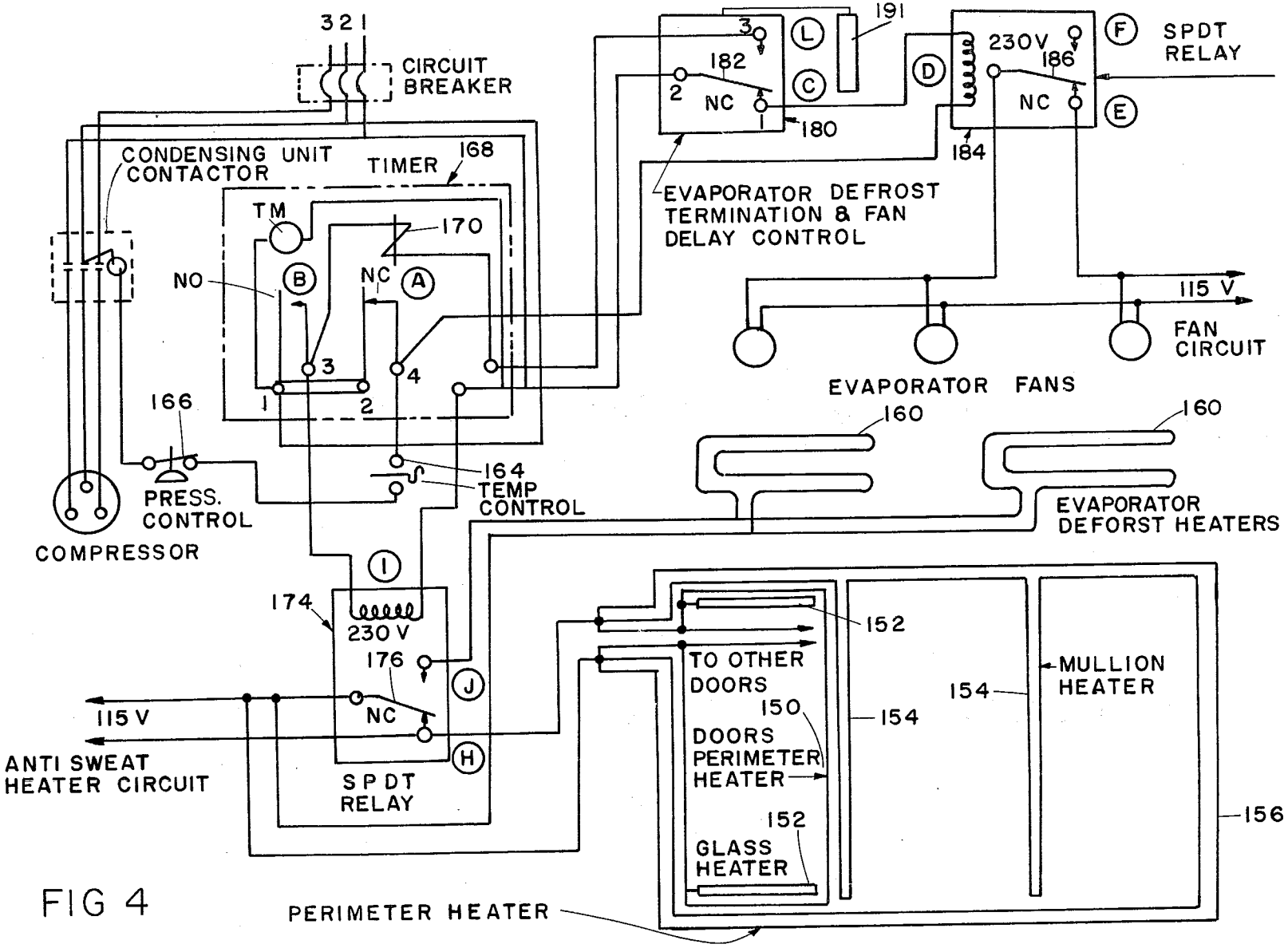
FIG. 4 is a schematic electrical diagram for the embodiment in FIG. 3.

On the face of the doors is mounted antisweat heaters which typically include door perimeter heaters 150 (FIG. 4), glass door heaters 152, mullion heaters 154, and case perimeter heater 156. Such heaters are typically resistance heaters, and serve to prevent condensation forming on the noted surfaces.

In accordance with this invention, there is located immediately adjacent coil 134, therebeneath, a plurality of defrost heater elements 160 (FIGS. 3 and 4) operated alternately with the noted antisweat heaters. Temperature control 164, pressure control switch 166 and a timer subassembly 168 govern these heaters as explained hereinafter. The timer subassembly includes timer motor TM which operates a normally closed timer switch A and a normally open timer switch B, and includes a solenoid 170. A single pole double throw relay 174 has a coil I, and a switch 176 normally closed at terminal H and normally open at terminal J for alternately operating the antisweat heaters and the evaporator defrost heaters, respectively. An evaporator defrost termination and fan delay control subassembly 180 includes a switch 182 normally closed to terminal C and normally open relative to terminal L. When closed to terminal C, the switch completes a circuit to coil D in single pole double throw relay 184, the switch 186 of which is normally closed to terminal E and normally open to terminal F. Terminal E and the switch thus complete a circuit to the electrical motors G for the evaporator fans 136. For clarity, the operational sequence is as follows:

REFRIGERATION MODE

1. Timer switch "A" is closed.
2. Timer switch "B" is open.
3. Defrost termination switch is in contact "C" position.
4. Relay coil "D" is energized, holding switch 186 in closed position at contact "E".
5. Evaporator fans run continuously until the defrost period.
6. Glass door and frame antisweat heaters are energized through one side of relay 174, terminal "H", from a separate 115 volt circuit as depicted.

DEFROST MODE

1. Defrost timer switch "A" is open and "B" is closed, being mechanically activated by the timer at a preset time.
2. Opening of switch "A" de-energizes coil "D", putting relay in "F" position stopping fan motors "G".
3. Closing of switch "B" energizes coil "I" in relay 174.
4. Energizing coil "I" puts relay in "J" position that energizes defrost heaters 160 and de-energizes antisweat heaters 150, 152, 154, and 156. The heat given off by the defrost heaters is confined within the space 130 to maximize defrost action with less energy consumption.
5. When the sensing bulb 191 of defrost termination control reaches the preset temperature (usually about 45 degrees F.) the control switch takes the position "L".
6. This activates solenoid 170 which returns the system to the refrigeration mode.

RESUMPTION OF REFRIGERATION MODE

1. Opening of switch "B" de-activates coil "I" and returns switch of relay 176 to "H" position. This terminates the heat in the defrost heaters and re-energizes the antisweat heaters.
2. When the sensing bulb of the defrost termination control reaches about +20 degrees F. the switch returns to position "C".
3. This reactivates the coil "D" and the relay switch returns to switch position "E" starting up the fans. There is preferably an approximately three minutes delay in starting up of the fans after refrigeration is started to allow proper lowering of the coil temperature before air flow through it, to avoid raising of the temperature in the product display and storage space.

In this door-type of display case, the energy requirements for antisweat heat are quite high, causing the diversion use thereof to be sufficient for defrost of the coil with confinement of the heat to the small coil chamber above the display space, with the fans not operating. The melted frost and ice from the coil flow into a trough 190 for flow out pipe 192 to drain.

Conceivably details of these two combination embodiments could be altered within the concept presented, the scope of the invention being set forth by the following claims and the reasonable equivalents thereto.

The embodiments of the invention in which an exclusive property or privilege is claimed are defined as follows.

1. A refrigerated display case operable in refrigeration mode and in defrost mode, and having a product storage space, evaporator cooling means for cooling air, air propelling means for circulating air through said evaporator cooling means and into said product storage and display space; electrical control means operably associated with said air propelling means for controlling air flow about said product storage and display space; said electrical control means having connection means for electrical power supply; electrical resistance antisweat heaters for said display case and a first electrical circuit therefor; electrical resistance heater means for said evaporator means and a second electrical circuit therefor; both said first and said second electrical circuits being connected to said electrical control means; and said electrical control means being operable to electrically actuate said first electrical circuit with said antisweat heaters and deactivate said second electrical circuit with said defrost heaters during said refrigeration mode and to activate said second electrical circuit with said defrost heaters and deactivate said first electrical circuit with said antisweat heaters during said defrost mode to cause antisweat energy to be diverted to use for defrost.

2. A refrigerated display case operable in refrigeration mode and in defrost mode, and having a product display and storage space, evaporator cooling means for cooling air, air propelling means for circulating refrigerated air in one direction through said evaporator cooling means and about said display space and for circulating defrost air in the opposite direction through said evaporator cooling means; electrical control means operably associated with said propelling means for causing refrigerated air flow in said one direction during the refrigeration mode of said case and ambient air flow in said opposite direction during the defrost mode of said case; said electrical control means having connection means for electrical power supply; electrical resistance antisweat heaters for said display case, and a first electrical circuit therefor; electrical resistance heater means for defrosting said evaporator means, and a second electrical circuit therefor; both said first and said second electrical circuits being connected to said electrical control means; and said electrical control means being operable for activating said first electrical circuit with said antisweat heaters and deactivating said second electrical circuit with said defrost heaters during said refrigeration mode, and for activating said second electrical circuit with said defrost heaters and deactivating said first electrical circuit with said antisweat heaters during said defrost mode, whereby antisweat energy is diverted for defrost in combination with ambient air flow.

3. The refrigerated display case in claim 2 being an open front display case having first conduit means for a recirculating refrigerated inner air curtain and second conduit means for an adjacent guard curtain during the refrigeration mode, said ambient air flow in said opposite direction in the defrost mode being heated by said defrost heaters prior to passage through said evaporator cooling means.

4. A refrigerated display case operable in refrigeration mode and defrost mode, and having a product storage space, evaporator cooling means for refrigerating air, air propelling means for circulating refrigerated air through said evaporator cooling means and into said product storage space; electrical control means operably associated with said propelling means for controlling air flow to deactivate said propelling means during said defrost mode and reactivate said propelling means during said refrigeration mode; electrical resistance antisweat heaters for said display case and a first electrical circuit therefor; electrical resistance heater means for said evaporator means and a second electrical circuit therefor; both said first and said second electrical circuits being connected to said electrical control means; and said electrical control means being operable for activating said propelling means and said first electrical circuit with said antisweat heaters and deactivating said second electrical circuit with said defrost heaters during said refrigeration mode and for activating said second electrical circuit with said defrost heaters and deactivating said propelling means and said first electrical circuit with said antisweat heaters during said defrost mode to cause antisweat energy to be diverted to defrost usage.

5. The refrigerated display case in claim 4 wherein said case includes an upper chamber above said product storage space housing said evaporator cooling means and said air propelling means, such that, during said defrost mode, heat from said defrost heaters is basically confined to said upper chamber.

6. The refrigerated display case in claim 5 wherein said defrost heaters are located immediately beneath said evaporator cooling means.

* * * * *